US006350329B1

(12) United States Patent
Troeger et al.

(10) Patent No.: US 6,350,329 B1
(45) Date of Patent: Feb. 26, 2002

(54) METHOD OF PRODUCING SUPERPLASTIC ALLOYS AND SUPERPLASTIC ALLOYS PRODUCED BY THE METHOD

(76) Inventors: Lillianne P. Troeger, 6108 Myrtle Park, Norfolk, VA (US) 23508; Edgar A. Starke, Jr., 2098 Garth Rd., Charlottesville, VA (US) 22901; Roy Crooks, 116 Villa Rd., Newport News, VA (US) 23601

( * ) Notice: Subject to any disclaimer, the term of this patent is extended or adjusted under 35 U.S.C. 154(b) by 0 days.

(21) Appl. No.: 09/332,736

(22) Filed: Jun. 14, 1999

Related U.S. Application Data

(60) Provisional application No. 60/089,236, filed on Jun. 15, 1998.

(51) Int. Cl.[7] ..... C21D 10/00
(52) U.S. Cl. ..... 148/564; 148/697
(58) Field of Search ..... 148/564, 697; 420/902

(56) References Cited

U.S. PATENT DOCUMENTS

| | | | | |
|---|---|---|---|---|
| 3,706,606 | A | 12/1972 | Di Russo et al. | |
| 3,847,681 | A | 11/1974 | Waldman et al. | |
| 4,092,181 | A | 5/1978 | Paton et al. | |
| 4,295,901 | A | 10/1981 | Robertson et al. | |
| 4,486,242 | A | 12/1984 | Ward et al. | |
| 4,528,042 | A | 7/1985 | Ward et al. | |
| 4,799,974 | A | 1/1989 | Mahoney et al. | |
| 4,861,391 | A * | 8/1989 | Rioja et al. | 420/902 |
| 5,181,969 | A | 1/1993 | Komatsubara et al. | |
| 5,573,608 | A | 11/1996 | Miyake et al. | |
| 5,772,804 | A | 6/1998 | Brown | |

OTHER PUBLICATIONS

Otsuka, et al., "Superplasticity in AL–MG–SI Monovariant Eutetic Alloys," Scripta Mettalurgica, vol. 8 (No. 12), p. 1405–1408, (Jun. 14, 1974).

Washfold, et al., "Thermomechanical Processing of an Al–Mg–Si Alloy," Metals Forum, vol. 8 (No. 1), p. 56, 52, 60, (Jun. 1, 1985), pp. 58, 59 missing.

Liu, et al., "Particle Stimulated Nucleation of Recrystallization in Al–Mg2Si," Aluminum Technology '86: Proceedings of the International Conference Sponsored and Organized by the Institute of Metals, The Institute of Metals, p. 347–356, (Jun. 1, 1986).

(List continued on next page.)

*Primary Examiner*—Sikyin Ip
(74) *Attorney, Agent, or Firm*—Foley & Lardner

(57) ABSTRACT

A method for producing new superplastic alloys by inducing in an alloy the formation of precipitates having a sufficient size and homogeneous distribution that a sufficiently refined grain structure to produce superplasticity is obtained after subsequent PSN processing. An age-hardenable alloy having at least one dispersoid phase is selected for processing. The alloy is solution heat-treated and cooled to form a supersaturated solid solution. The alloy is plastically deformed sufficiently to form a high-energy defect structure useful for the subsequent heterogeneous nucleation of precipitates. The alloy is then aged, preferably by a multi-stage low and high temperature process, and precipitates are formed at the defect sites. The alloy then is subjected to a PSN process comprising plastically deforming the alloy to provide sufficient strain energy in the alloy to ensure recrystallization, and statically recrystallizing the alloy. A grain structure exhibiting new, fine, equiaxed and uniform grains is produced in the alloy. An exemplary 6xxx alloy of the type capable of being produced by the present invention, and which is useful for aerospace, automotive and other applications, is disclosed and claimed. The process is also suitable for processing any age-hardenable aluminum or other alloy.

50 Claims, 13 Drawing Sheets

OTHER PUBLICATIONS

Bampton, et al., "Treatise on Materials Science and Technology," Chapter 7: Superplastic Aluminum Alloys, Academic Press, p. 189–216, (Jun. 1, 1989).
Zaida, et al., "Treatise on Materials Science and Technology," Chapter 5: Thermomechanical Processing of Aluminum Alloys, Academic Press, p. 137–170, (Jun. 1, 1989).
Kovacs, et al., "Superplasticity of AlMgSi Alloys," Journal of Materials Science, p. 6141–6145, (Jun. 1, 1992).
Chung, et al., "Grain Refining and Superplastic Forming of Aluminum Alloy 6013," The 4th International Confernce on Aluminum Alloys, p. 434–442, (Jun. 14, 1994).

Nieh, et al., "Superplasticity in Metals and Ceramics," Chapters 1–5, Cambridge University Press (United Kingdom), p. 1–90, (Jun. 14, 1997).

* cited by examiner

METHOD OF PRODUCING SUPERPLASTIC ALLOYS AND SUPERPLASTIC ALLOYS PRODUCED BY THE METHOD

CROSS-REFERENCE TO RELATED PROVISIONAL APPLICATION

The present application claims the benefit of the earlier filing date of U.S. Provisional Patent Application Serial No. 60/089,236; filed Jun. 15, 1998, which is incorporated by reference herein in its entirety.

STATEMENT CONCERNING FEDERALLY SPONSORED RESEARCH

This invention was made with government support under NASA Training Grant No. NGT-1-52117. The U.S. Government has certain rights in the invention.

FIELD OF THE INVENTION

The present invention relates to a method for producing fine-grained alloys, particularly fine-grained 6xxx aluminum alloys which exhibit superplasticity, and to the alloys produced by the method.

BACKGROUND OF THE INVENTION

The advantages of superplastic properties in metals are well known, and particularly well employed in the automotive and aerospace industry. Because of their fine-grained microstructures, superplastic metals and alloys may exhibit from several hundred percent to several thousand percent elongation without necking when pulled in tension at temperatures 20 exceeding 0.5 $T_m$, where $T_m$ is the absolute melting temperature of the material. In contrast, non-superplastic metals and alloys typically elongate less than 100% before necking under similar conditions. Accordingly, superplastic metals may be formed into a multitude of complex shapes not achievable with other metals.

Currently, commercial interest in the aerospace and automotive industries is focused on superplastic forming ("SPF"). SPF is a manufacturing process which exploits the phenomenon of superplasticity by using low gas pressures (less than about 1000 psi (7 MPa)), and concomitantly low energies, to form parts having complex shapes. This process reduces part counts and the need for fasteners and connectors, reducing product weight and manufacturing costs. In addition, SPF may be performed using a single surface tool in a single forming operation, thus reducing tooling costs. The advent of SPF therefore increases the potential commercial applications in which superplastic materials may be employed.

Superplastic behavior in metallic alloys may be described by the equation $$\sigma = k\epsilon^m$$

where $\sigma$=flow stress, k=material constant, $\epsilon$=strain rate, and m=strain rate sensitivity. In superplastic metals, m usually ranges from about 0.4 to 0.8. "Quasi-superplastic" metals and alloys have m values of around 0.33. Materials having m values less than 0.3 are considered to be non-superplastic.

Most metals and alloys capable of achieving superplasticity must be specially processed for superplasticity. The microstructures of such metals and alloys may be refined through thermomechanical processing to impart such properties to the material. For a material to be superplastic, it is typically refined to possess an equiaxed, fine-grained structure, typically with grains about 20 $\mu$m or less in diameter and preferably about 10 $\mu$m or less. In addition, for such a material to be commercially useful, it must be statically stable such that its grains do not experience significant growth at superplastic forming temperatures. Where the thermomechanical process for refinement includes static recrystallization, which is a common component of such processes, a weak or random texture and the presence of predominantly high-angle grain boundaries is also required. The development of thermomechanical processes effective for creating alloys having such properties has proven to be extremely challenging.

An extensive amount of research has been conducted in an effort to discover thermomechanical processes useful for producing superplastic alloys, including aluminum alloys. This work has resulted in the development of several superplastic alloys, but undoubtedly, many commercially important superplastic alloys have yet to be discovered. In particular, although several superplastic 2xxx, 5xxx, 7xxx and 8xxx aluminum alloys have been produced, there has been a significant deficiency in successful research concerning the grain refinement and superplasticity of 6xxx aluminum alloys. New superplastic 6xxx aluminum alloys would be particularly desirable, because 6xxx alloys are highly weldable, corrosion resistant, extrudable and low in cost compared with other aluminum alloys. Thus, there is a need for the development of methods for imparting superplastic properties to alloys, particularly 6xxx aluminum alloys.

Of the 6xxx aluminum alloys, 6061, 6063, 6066, and especially 6013 and 6111, possess substantial promise for extensive use in the aerospace and automotive industries. Indeed, non-superplastic aluminum alloy 6013, a medium strength, age-hardenable alloy developed by ALCOA in the early 1980s, has been selected for use on Boeing Co.'s state-of-the-art 777 aircraft, as well as for many other automotive and aerospace applications. This is not surprising, given the favorable properties of this alloy and the fact that it can be processed to develop properties superior to other 6xxx alloys. For example, it has corrosion resistance superior to that of 2xxx and 7xxx aluminum alloys, which are heavily used for aerospace applications. The yield strength of 6013-T6 is 12% higher than that of 2024-T3, it is nearly immune to corrosion that results in exfoliation and stress-corrosion cracking, and it is 25% stronger than 6061-T6. In addition, the alloy 6013-T4 has better stretch-forming characteristics than other aerospace aluminum alloys. Accordingly, there is a need for the development of methods for imparting superplastic properties to 6061, 6063, 6066 alloys, and particularly to 6013 and 6111 aluminum alloys.

To date, efforts expended to impart superplasticity to 6xxx aluminum alloys have not been very successful. U.S. Pat. No. 4,092,181 to Paton, et al., which describes what is known in the art as the "Rockwell process," discloses a method for imparting a fine grain structure to aluminum alloys having precipitating constituents. The thermomechanical process of the Paton, et al. method consists of solution heat treating such an alloy, overaging the alloy, then subjecting the alloy to a particle-stimulated nucleation ("PSN") process during which the alloy is mechanically worked and recrystallization is induced. Although the Paton, et al. patent provides several examples of the method described therein, it does not describe the microstructures produced by the method, nor does it suggest that superplastic results were achieved. Indeed, experimental evidence available in the literature indicates that the method disclosed by Paton, et al. is not very useful for imparting superplasticity to 6xxx alloys. This is confirmed by the work performed in connection with the present invention, as described below.

Similarly, Washfold, et al. attempted to grain refine a 6063 aluminum alloy through PSN in order to induce superplasticity. See Washfold, et al., "Thermomechanical Processing of an Al—Mg—Si Alloy," Metals Forum (1985) at 56–59. The thermomechanical process used is very different than that employed in the present invention, and consists of a solution heat-treatment followed by slow cooling to an overaging temperature, overaging, slow cooling to room temperature, cold or warm rolling, and static recrystallization with a slow heat-up to the recrystallization temperature. Washfold, et al. produced a microstructure exhibiting a minimum grain diameter of 10.5 $\mu$m (in the rolling plane), as measured using optical microscopy ("OM") techniques. They obtained a maximum elongation of 148% at 450° C., due to significant grain growth occurring at 500° C. and above, within the superplastic forming temperature range. The Washfold, et al. process did not achieve superplasticity.

Kovacs-Csetenyi, et al. attempted to use compositional variation and thermomechanical processing to refine the grain structure and improve the superplastic performance of aluminum 6066 and three variants of aluminum 6061. See Kovacs-Csetenyi, et al., "Superplasticity of AlMgSi Alloys," Journal of Materials Science 27 (1992) at 6141–45. The thermomechanical process used consists of solution heat-treatment followed by overaging, rolling, and static recrystallization, and bears no resemblance to that of the present invention. Kovacs-Csetenyi, et al. report strain rate sensitivity values in the range of 0.4 for each of the four alloys processed, as studied using temperatures between 500° C. and 570° C. and strain rates of $10^{-3}$ to $10^{-6}$ $s^{-1}$, indicating that some degree of superplastic behavior would be expected from the alloys. However, superplasticity was characterized using impression creep tests, and no uniaxial tensile tests were reported. Thus, it is unclear what amounts of superplastic elongation, if any, were obtained by the processing technique described in this reference.

Chung, et al. also experimented with grain refinement techniques to produce a superplastic 6013 alloy. See Chung, et al., "Grain Refining and Superplastic Forming of Aluminum Alloy 6013," The $4^{th}$ International Conference on Aluminum Alloys (1994), 434–42. Chung, et al. employed a thermomechanical process consisting of solution heat-treatment, 10% cold rolling, overaging at 380° C., 90% warm rolling at 190° C., and recrystallization. In contrast to the process of the present invention, Chung, et al. employed mild cold rolling, for the purpose of forming a dislocation network to assist in the precipitation of what was thought to be $Mg_2Si$ precipitates. The process resulted in grains of 12 to 13$\mu$m (measured using optical microscopy techniques), a strain rate sensitivity of 0.38, and a maximum elongation of 230% at 520° C. for a strain rate of $3\times10^{-4}$ $s^{-1}$, and at a flow stress of 972 psi (6.7 MPa). Thus, the product of the Chung, et al. process was only marginally superplastic. Chung, et al. concluded that the size and number of iron-bearing constituents in the alloy needed to be reduced in order to achieve more favorable results. Chung, et al. clearly were not aware that, as disclosed by the present invention, a significantly higher energy deformation structure such as a deformation band needed to be imparted to the material and exploited to form sites for the heterogeneous nucleation of precipitates, enabling the achievement of a superplastic microstructure.

A similar process to that employed by Chung, et al., but directed to an altogether different purpose, is described in U.S. Pat. No. 3,706,606 to DiRusso, et al. The DiRusso patent addresses the need to develop processes for increasing the mechanical strength of semifinished aluminum alloys. Like Chung, et al., the DiRusso patent describes using a mild cold or warm rolling between solution heat-treatment and aging steps to provide a dislocation network to assist in precipitation. None of the alloys treated using the process of the DiRusso patent exhibited superplastic properties, as shown by the tensile elongation tests performed by DiRusso, et al. on such alloys, nor were they intended to do so.

Accordingly, it is an object of the present invention to provide alloys exhibiting superplasticity, particularly 6xxx alloys and especially aluminum 6013 and 6111 alloys.

It is another object of the present invention to provide a method for imparting superplastic properties to alloys that is applicable to a wide range of alloys, particularly all 6xxx alloys and especially aluminum 6013 and 6111 alloys.

It is yet another object of the present invention to provide a method for imparting superplastic properties to alloys that is economical and commercially useful.

It is still another object of the present invention to provide a method for producing superplastic alloys having an equiaxed, uniform, thermally stable, fine grain structure of less than about 20 $\mu$m, and preferably about 10 $\mu$m or less.

It is another object of the present invention to provide a method for producing superplastic alloys having a microstructure with a weak or random texture and a predominance of high-angle grain boundaries.

SUMMARY OF THE INVENTION

In accordance with the principles of the present invention, alloys exhibiting superplasticity and a method for producing the same are provided. The method involves inducing in an alloy the formation of precipitates having a sufficient size and homogeneous distribution such that, after a subsequent PSN process, a sufficiently refined grain structure to produce superplasticity results. The process of the present invention differs from previous processes in the particular thermomechanical processing steps required, as well as in the sequence and character of those steps. Because of these differences, the process of the present invention is capable of imparting to age-hardenable alloys, and particularly to age-hardenable aluminum alloys, exceptional superplastic characteristics heretofore not obtainable. An exemplary alloy of the type capable of being produced by the present invention is a superplastic 6xxx alloy which is economically produced and commercially useful for aerospace, automotive and other applications.

The method for producing a superplastic alloy, as provided by the present invention, comprises providing an age-hardenable alloy for processing which has a matrix phase and at least two alloying elements, at least one of the alloying elements being, or being capable of forming, a dispersoid phase substantially insoluble in the matrix phase after basic ingot processing. The alloy is solution heat-treated, and cooled to form a supersaturated solid solution. The alloy is then plastically deformed sufficiently to form a high-energy defect structure, thereby forming nucleation sites useful for the subsequent heterogeneous nucleation of precipitates. The alloy is then aged, forming precipitates at the nucleation sites, and subjected to deforming and recrystallizing through a PSN process.

This process has been shown to effect excellent results in a variant of an aluminum 6013/6111 alloy, but is suitable for processing any age-hardenable alloy. Aluminum alloys, particularly 6xxx aluminum alloys, and more particularly 6013, 6111,6061, 6063 and 6066, are particularly good candidates for processing under the present method.

The cooling step following solution heat-treatment may be performed using any mode of rapid cooling. For example, it may be performed by quenching in media such as water, oil or air. The step of plastically deforming the alloy must be sufficiently severe to form a high-energy defect structure, such as the high-energy defect structures commonly referred to as "deformation bands," in contrast to lower-energy defect structures such as a dislocation network. Such severe plastic deformation may be imparted by any means, such as a rolling, stretching, extrusion, drawing, forging or torsion process at economical temperatures and conditions, and is preferably imparted by cold rolling at room temperature.

The aging process of the present invention may comprise a single heating step in which the alloy is heated at a single temperature for a set period of time, or multiple heating steps in which the alloy is heated at different temperatures over set time periods. Preferably, the aging process comprises a first heating step at a first temperature and a second heating step at a second higher temperature. The first heating step may be used to form the precipitates, which then may be coarsened during the second heating step. Where two or more heating steps are used, the alloy preferably is cooled after each heating step.

The PSN process preferably includes plastically deforming the alloy to provide sufficient strain energy in the alloy to ensure recrystallization, and statically recrystallizing the alloy. The plastic deformation step of the PSN process may include any mode of plastic deformation, but preferably comprises cold rolling the alloy at room temperature. The static recrystallization step of the PSN process preferably includes rapidly heating the alloy to a temperature at which recrystallization occurs and at which recovery is minimized. In one embodiment, such rapid heating is provided by selecting a recystallization temperature in the range of the solution heat-treatment temperature for the alloy. In another embodiment, rapid heating is provided by heating the alloy to the superplastic forming temperature of the alloy.

One of the alloys which may be processed to exhibit exceptional superplastic properties using the method of the present invention is a 6013/6111 aluminum alloy having the approximate composition 97.3 wt % Al—0.8 wt % Mg—0.7 wt % Si—0.8 wt % Cu—0.3 wt % Mn—0.1 wt % Fe. In one embodiment of the present invention, the solution heat-treating step is performed by heating this alloy at a temperature of about 540° C. for about one hour, excluding heat-up time. The solution heat-treated alloy is then rapidly cooled, preferably by cold water quenching. The alloy is then plastically deformed to a sufficient degree to form the required deformation bands or other high-energy defect structures in the material. This may be done, for example, by cold rolling at room temperature by about 30% or more. Most preferably, the plastic deformation is performed such that, after subsequent aging, the alloy will exhibit a uniform distribution of globular or near-spheroid shaped precipitates. Aging may be performed using any combination of aging steps, but preferably is performed using a two-step aging process. In one embodiment of the invention, a first heating step is performed at about 300° C. for about 24 hours and a second heating step is performed at about 380° C. for about 24 hours, with the alloy being cooled after the each of the heating steps. Precipitates preferably are formed during the first heating step and coarsened during the second heating step.

According to another exemplary embodiment, the 6013/6111 superplastic aluminum alloy of the present invention may be aged using a first heating step at about 300° C. for about 24 hours, and a second heating step at about 450° C. for about 2 hours. Under yet another exemplary embodiment, the alloy may be aged using a single heating step, at a temperature of about 450° C. for about 2 hours. Although the microstructure of this single-heating step alloy may be somewhat less ideal than those of the alloys produced using the dual heating steps of the other exemplary embodiments, such a low temperature/short heating time process may be preferred for commercial applications where energy consumption and time are important factors.

After aging, the 6013/6111 aluminum alloy of the present invention is plastically deformed to provide sufficient strain energy in the alloy to ensure recrystallization. In one embodiment of the invention, the alloy is cold rolled at room temperature by about 80% or more. In particular, cold rolling at room temperature by about 80%, 87% and 92% has produced exceptional results. Smaller amounts of plastic deformation may also be employed. The alloy is then recrystallized. In connection with the recrystallization step, the alloy should be rapidly heated to the temperature at which recrystallization occurs to minimize recovery within the deformation zones around the precipitates and to activate the largest number of recrystallized nuclei. In one embodiment of the invention, the alloy is rapidly heated to about 540° C. and held there for about five minutes.

Processing the 6013/6111 aluminum alloy as discussed yields a superplastic alloy with a microstructure having a fine average grain size in the range of about 9.5 μm to about 11.6 μm, the grain sizes having a standard deviation in the range of about 4.7 μm to about 5.6 μm. In addition, the mlcrostructure of the alloy has a low average grain aspect ratio (i.e., ratio of major axis to minor axis) in the range of about 1.6 to about 1.9, the grain aspect ratios having a standard deviation in the range of about 0.6 to about 0.8. The alloy also has a grain roundness in the range of about 1.6 to about 1.8, a maximum strain rate sensitivity of at least about 0.5, and a maximum elongation capability of at least about 350%, preferably 375% or more. Specifically, in one embodiment, processing the 6013/6011 alloy using a first heating step at about 300° C. for about 24 hours and a second heating step at about 380° C. for about 24 hours, with the alloy being cooled after the each heating step, and subsequently cold rolling the aged alloy by about 87% and recrystallizing the alloy at about 540° C. for about five minutes, yields an average grain size of about 9.5 μm (about 4.7 μm standard deviation), and an average grain aspect ratio of about 1.6 (about 0.6 standard deviation). The resulting alloy has a maximum strain rate sensitivity of about 0.5 at 540° C. for a strain rate range of $2\times10^{-4}$ $s^{-1}$ to $5\times10^{-4}$ $s^{-1}$, and a maximum elongation of 375% with a corresponding maximum stress of approximately 680 psi (4.7 MPa).

The foregoing and other features, objects and advantages of the present invention will be apparent from the following detailed description, taken in connection with the accompanying figures, the scope of the invention being set forth in the appended claims.

DETAILED DESCRIPTION OF THE INVENTION

The preferred embodiments of the method of the present invention, and the alloys produced in accordance with the present invention, will now be described.

Providing An Alloy

According to the method of the present invention, an alloy must be provided for processing. Any age-hardenable alloy, such as a 2xxx, 6xxx, 7xxx and some 8xxx aluminum alloy, conceivably is a candidate for processing in accordance with this invention. The alloy must include a matrix phase and at least two alloying elements, at least one of the alloying elements being, or being capable of forming, an insoluble dispersoid phase present as particles typically less than one micron in diameter which are substantially insoluble in the matrix phase of the alloy. The dispersoids are utilized by the present invention during recrystallization to help retain a fine grain structure by limiting grain growth.

Although the process does not require any particular alloy composition, it has been demonstrated to work particularly well for a variant of an aluminum 6013/6111 alloy having the approximate composition 97.3 wt % Al—0.8 wt % Mg—0.7 wt % Si—0.8 wt % Cu—0.3 wt % Mn—0.1 wt % Fe. The alloy was cast and ingot-processed by Reynolds Metals Company at Reynolds' Richmond, Va. facility. One half of the ingot was preheated in the conventional manner using a heat-up rate of about 50° C./hour, a soak temperature of about 560° C., and a soak time of about four hours. The other half of the ingot underwent a low-temperature preheat (about 500° C.) using a heat-up rate of about 50° C./hour and a soak time of about eight hours, to achieve a finer size distribution and slightly higher volume fraction of dispersoids than that obtained using the conventional preheat. Each ingot was then rolled to form an approximately 1" thick plate.

It should be noted that the terms "about" or "approximately," as used in the present application, are intended to encompass values within ±25% of the stated value.

Solution Heat-Treatment

Figure 1:
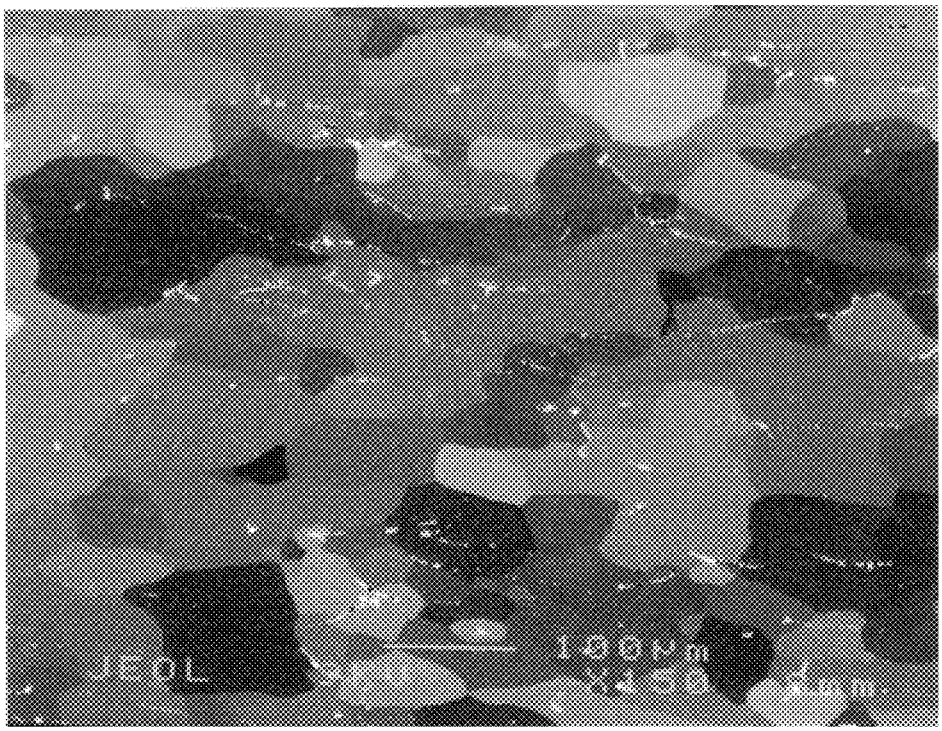
FIG. 1 is a SEM micrograph (150×) of a 6013/6111 alloy, produced in accordance with the method of the present invention, following solution heat treatment.

The alloy selected for processing is solution heat-treated in the conventional manner. It will be readily appreciated that the temperature and heating time of this step depend upon the type and thickness of the alloy being processed, and that for standard alloys, these parameters may be readily ascertained from the alloy's manufacturer or material data sheet. In any event, the alloy should be heated to a temperature below that at which melting begins, and the heating time should be sufficient to achieve the dissolution of all normally soluble phases. For the 1" thick plate samples discussed above, an air furnace was preheated to a temperature of about 540° C. The samples were placed in the furnace for a period of about one hour, excluding heat-up time. A SEM micrograph (150×) of a sample of this material following solution heat-treatment is shown in FIG. 1.

Rapid Cooling

Following solution heat-treatment, the alloy must be cooled to form a supersaturated solid solution, Although the mode of cooling is not critical, rapidly cooling the alloy to a temperature at which the diffusion rate of any of the elements in the alloy is not appreciable, and the formation of precipitates prevented, ensures the retention of the equilibrium number of atomic vacancies (or as many of such vacancies as practicable) from solution heat-treatment. This will assist in the diffusion and nucleation of precipitates during the aging step of the present invention, which is discussed in detail below. Rapid cooling will also serve to trap as much solute in solid solution as possible, making the maximum amount of solute available for the subsequent formation of precipitates during aging. The rapid cooling may be accomplished, for example, by quenching in a medium such as water, oil or air, or any other known rapid cooling mechanism.

The alloy forming the 1" thick plates discussed in the example above was particularly sensitive to the speed of the cooling process. Accordingly, the plates were quenched using room temperature water.

Plastic Deformation

In accordance with the method of the present invention, once solution heat-treatment is complete, the alloy must be sufficiently plastically deformed to produce high-energy defect structures, such as the high-energy defect structures commonly referred to as "deformation bands." Such high-energy defect structures may be exploited to promote a more uniform distribution of heterogeneously nucleated precipitate particles after aging than would otherwise be obtainable.

Figure 5A:
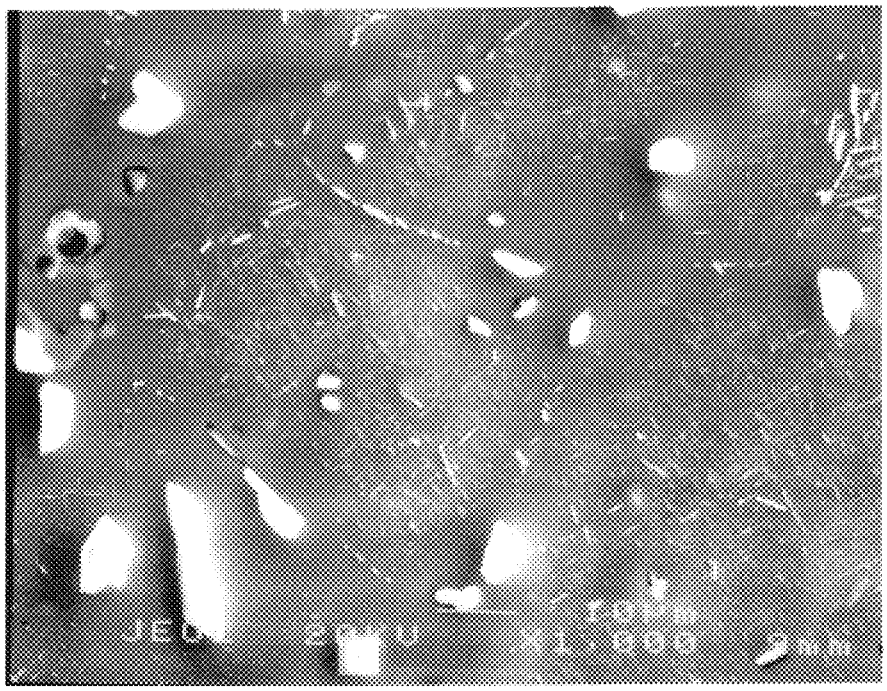
FIG. 5*a* is a SEM micrograph (1000×) illustrating the distribution of precipitates in an 8% stretched 6013/6111 sample heated at 380° C. for 17 hours.

In contrast, attempts recently have been made to achieve such a favorable distribution of precipitates by imparting deformation to the material sufficient to induce a dislocation network, a lower-energy defect structure than contemplated by the present invention. As discussed previously, Chung, et al. attempted to obtain such a dislocation network by cold rolling, but with marginal results. In fact, the inventors hereof attempted to improve upon Chung, et al.'s efforts by stretching the subject material, since stretching would be expected to impart a more uniform deformation across the thickness of the material. This effort, too, was unsuccessful. FIG. 5*a* shows precipitates that resulted from 8% stretching, after the material had been heated at 380° C. for 17 hours. Amounts of stretching from about 0% to 8% and heating times of about 2 to 17 hours resulted in precipitates having a similar appearance to those shown in FIG. 5*a*.

The inventors hereof have found that, instead of dislocation networks, substantially higher-energy defects such as deformation bands must be formed. Deformation bands provide nucleation sites at the interfaces of the bands which may be exploited to homogenize the precipitate distribution as needed for producing the fine-grained structure necessary for inducing superplasticity. Deformation bands are just one type of high-energy defect structure that may be useful in the process of the present invention, however, and it is not intended that the present invention be limited to the use of deformation bands. For example, other high-energy defect structures known as microbands, kink bands and bands of secondary slip may be used to equal effect.

Deformation bands or other high-energy defect structures useful under the present invention may be obtained by severely plastically deforming the solution heat-treated alloy. Many processes for plastically deforming a material are known to those skilled in the art, such as rolling, stretching, extrusion, drawing, forging, and torsion processes, among others. It is anticipated that any mode of plastic deformation may be used, so long as it is sufficiently severe to produce the required high-energy defect structure in the grains of the material. Preferably, the amount of reduction per pass and number of passes is such that the deformation fully penetrates the alloy. It is also preferable that the deformation be uniform throughout the thickness of the alloy.

The deformation of the solution heat-treated alloy preferably is carried out at room temperature, although this temperature will vary with alloy composition, since some alloying additions, such as magnesium in solid solution, are known to lower the dynamic recovery rate. This step also may be carried out at other temperatures. Most preferably, the deformation is performed at whatever temperature is most convenient and economical, provided that sufficient energy is retained in the alloy for the formation of a high-energy defect structure.

It is well-known that some alloying elements enhance the work hardening behavior of alloys when such alloying elements are present in solid solution. For example, magnesium is known to have this effect in aluminum alloys, and makes possible the high strengths developed in wrought 5xxx alloys. Indeed, aluminum alloys containing Mg in solid solution, such as the 6013/6111 alloy formed in accordance with the process of the present invention, may develop greater stored strain energy for a given amount of deformation than alloys not containing Mg. Accordingly, the high-energy defect structures required for the process of the present invention may be more readily attainable for alloys containing one or more strength-enhancing alloying elements such as Mg than for alloys not having such alloying elements.

Figure 2A:
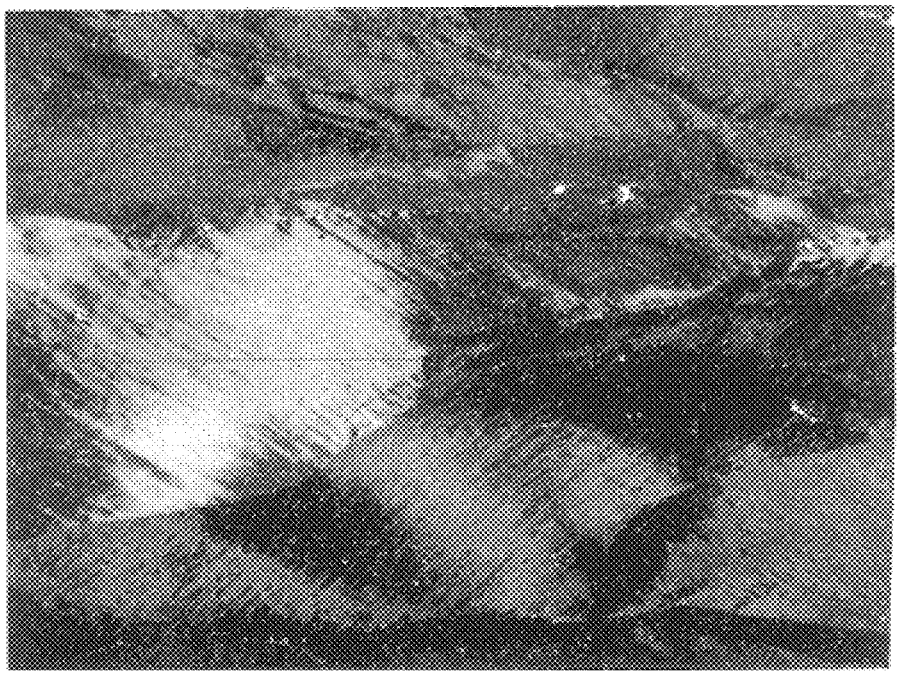
FIG. 2*a* is a SEM micrograph (500×) illustrating banded deformation structures produced in 30% cold rolled sample E in accordance with the method of the present invention.
Figure 2B:
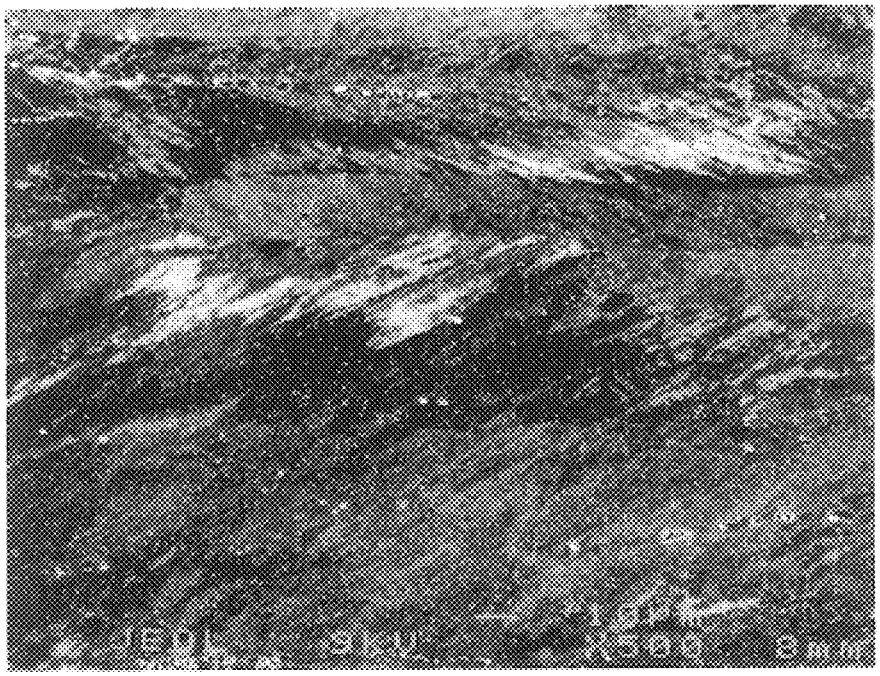
FIG. 2*b* is a SEM micrograph (500×) illustrating banded deformation structures produced in 60% cold rolled sample A in accordance with the method of the present invention.

For the example of the 1" thick plate described above (standard preheat), unidirectional, room temperature rolling was carried out on 8.5" diameter rolls rotated at 11 rpm. The plate was reduced in thickness by about 10% per pass for a total of 9 passes. The microstructures of two such samples (rolling reduction of about 30% and 60%) were examined using SEM micrographs obtained using the electron channeling contrast technique in a JEOL™ JSM-6400 scanning electron microscopy ("SEM") microscope, exhibited banded deformation structures as shown in FIGS. 2*a* and 2*b*.

Figure 3A:
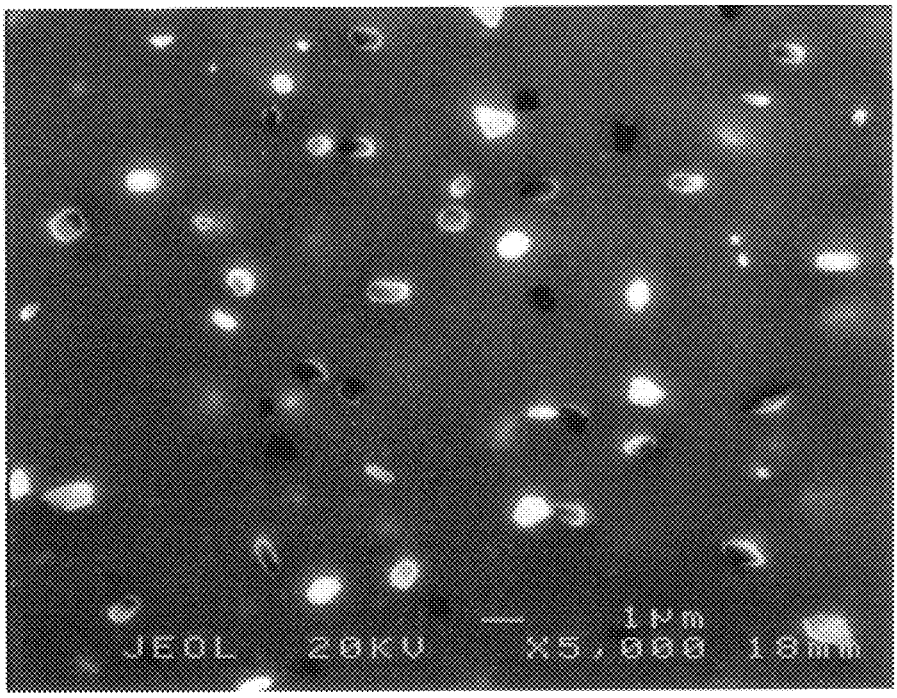
FIG. 3*a* is a SEM micrograph (5000×) illustrating globular or near-spheroid shaped precipitates as produced in sample A in accordance with the method of the present invention.
Figure 3B:
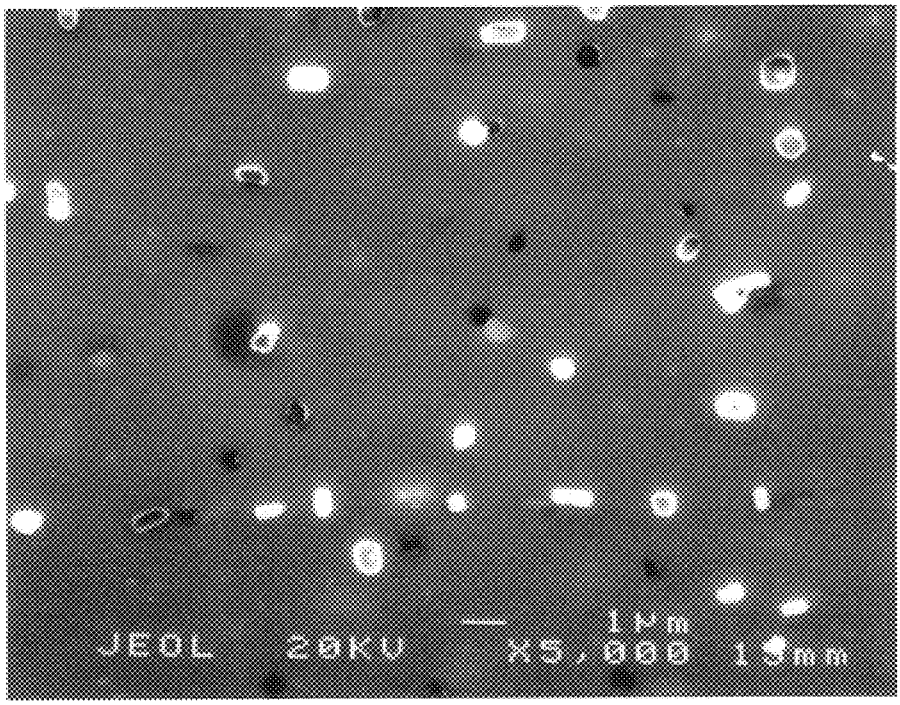
FIG. 3*b* is a SEM micrograph (5000×) illustrating globular or near-spheroid shaped precipitates as produced in sample B in accordance with the method of the present invention.
Figure 3C:
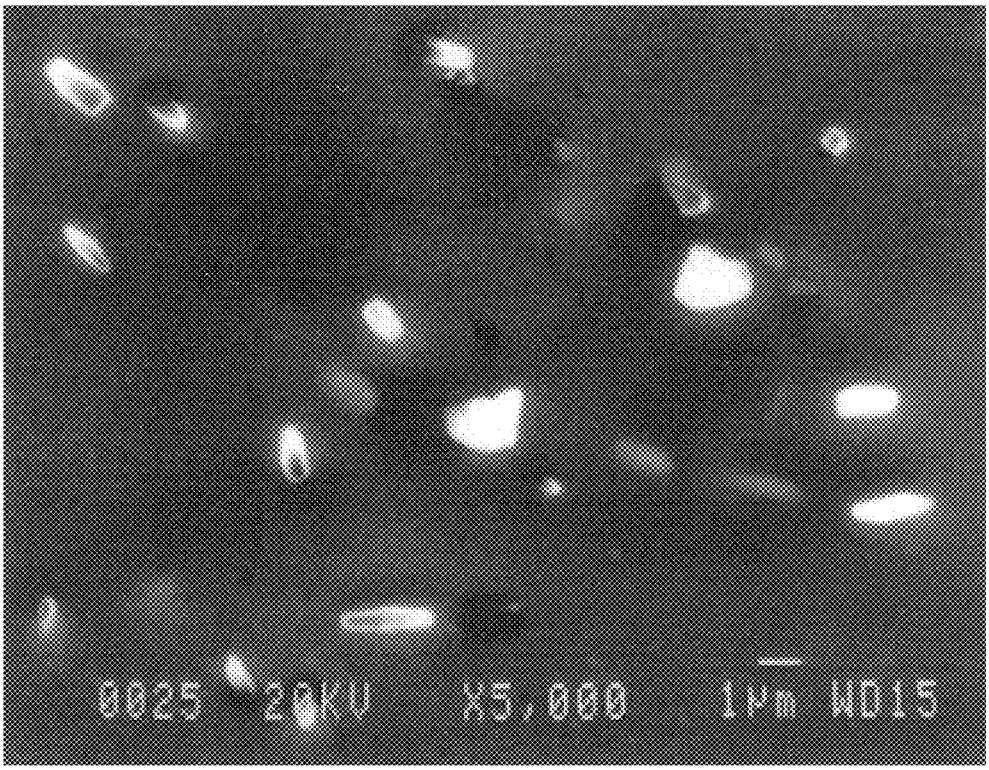
FIG. 3*c* is a SEM micrograph (5000×) illustrating globular or near-spheroid shaped precipitates as produced in sample C in accordance with the method of the present invention.

Following the aging step discussed below, a homogeneous precipitate distribution was observed. In addition, an unexpected and surprising effect of the severe deformation step also was observed. Each of the samples subjected to aging after being plastically deformed in accordance with the present invention exhibited precipitates that were globular or near-spheroid in shape, as can be seen in FIGS. 3*a*, 3*b* and 3*c*. Such morphologies are believed to be preferable over precipitates having other shapes, such as the thin, square, plate-like morphologies that form in the absence of the severe deformation disclosed herein, because spheroid or near-spheroid precipitates should be able to store strain more uniformly. The formation of such globular precipitates is therefore believed to be a significant synergistic advance presented by the present invention.

Aging

Once the alloy has been plastically deformed, it is aged to induce the nucleation and growth of precipitates. The preferred times and temperatures for the aging process are dependent upon the type of alloy used, and are well known in the art (or may be obtained from the alloy manufacturer) for standard alloys. Where a unique alloy is being processed with respect to which such times and temperatures have not been established, the known times and temperatures for analogous alloys will provide a highly useful reference point. As is well known, low aging temperatures require longer aging periods, whereas high aging temperatures require shorter aging periods to achieve the same effect.

The aging process is preferably accomplished using more than one heating step, such that a relatively low temperature aging step may be used to form a fine distribution of precipitates, while one or more subsequent higher heating steps may be used to increase the speed of coarsening once precipitates have been formed in order to provide sufficiently coarse particles to stimulate recrystallization. Beginning the aging process with a relatively lower temperature increases the driving force for precipitation, thereby increasing the number density of precipitates, and continuing the aging process with a relatively higher temperature decreases the aging time and enhances the economy of the process.

As will be appreciated, a single step aging process involving the use of a single low or high-temperature aging step may also be used to form the desired distribution of precipitates. As is explained in connection with the example discussed below, however, it is possible that the preferred globular or near-spheroid precipitate morphology will not be obtained where a single low-temperature aging step is used. Alternatively, the use of a single, high-temperature step may be adequate to provide the preferred precipitate morphology, but may not provide as favorable a precipitate distribution. It has been found that by utilizing a low-temperature aging step followed by a high-temperature aging step, both the preferred morphology and distribution of precipitates may be realized.

Regardless of how many aging steps are used, the alloy may be cooled after each aging step, preferably by air cooling. Air cooling should result in a larger volume fraction of precipitates because the degree of supersaturation of the matrix is increased as the sample cools, while there is still enough thermal energy available for the diffusion of solute atoms to the precipitate interfaces. Air cooling is also easier and less-costly to implement than other cooling methods such as quenching.

Exemplary samples of plastically deformed plates of the type discussed previously (identified below as samples A through E) were processed using single and dual precipitation heating steps, as shown in Table 1.

TABLE 1

EXEMPLARY AGING PROCESSES

| Samples | % Cold Rolling | Time at 300° C. (hours) | Time at 380° C. (hours) | Time at 450° C. (hours) |
|---|---|---|---|---|
| A | 60 | 24 | 24 | 0 |
| B | 60 | 24 | 0 | 2 |
| C | 60 | 0 | 0 | 2 |
| D | 0 | 24 | 24 | 0 |
| E | 30 | 24 | 24 | 0 |

The temperatures and heating times of the samples were varied in an attempt to optimize the size, shape and distribution of the precipitates. With respect to the approximately 60%-rolled samples A and B, the presence of precipitates along parallel deformation bands was apparent after only about one minute of heating at about 300° C. For the approximately 60%-rolled samples, the precipitated zone was wider than for the approximately 30%-rolled samples. After additional heating, precipitation between the deformation bands was visible, resulting in a fairly homogeneous distribution of precipitates less than 1 $\mu$m in size.

The 60%-rolled samples A, B and C were analyzed further, and each of the three samples exhibited a generally uniform distribution of globular precipitates about 1–3 $\mu$m in diameter, as shown in FIGS. 3*a*, 3*b* and 3*c*, respectively. As noted previously, globular or low aspect ratio precipitates are believed to be preferable over precipitates having other shapes, because spheroid or near-spheroid precipitates are able to store deformation more uniformly.

Figure 4A:
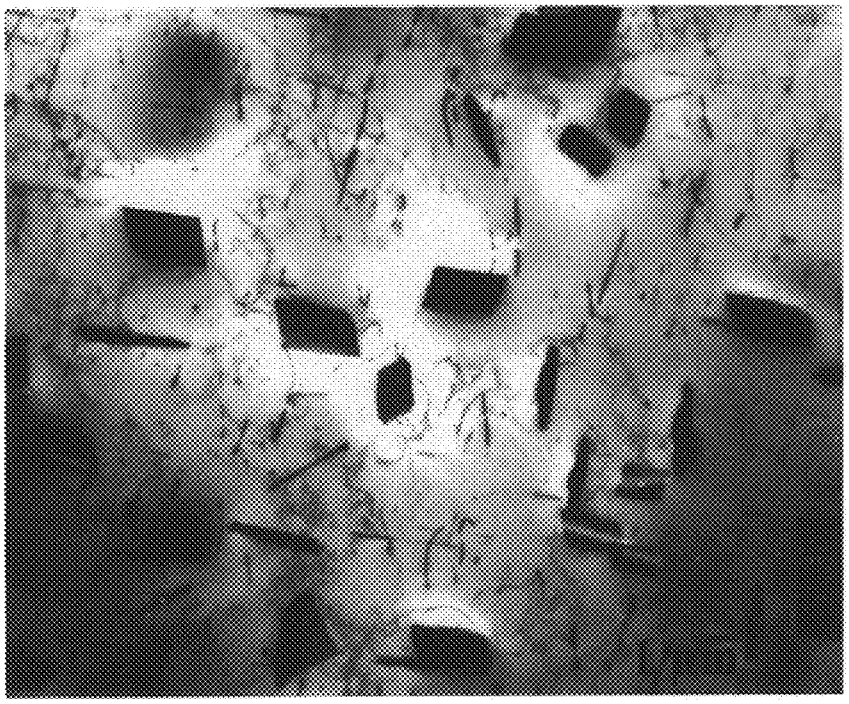
FIG. 4*a* is a TEM micrograph (3300×) of sample D after the aging step of the present invention.
Figure 4B:
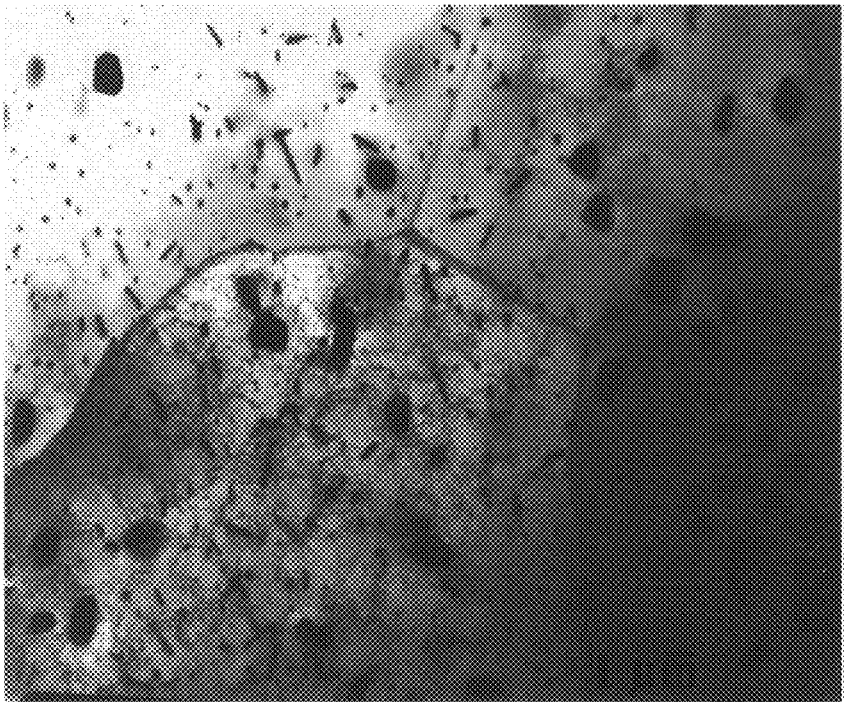
FIG. 4*b* is a TEM micrograph (3300×) of sample A after the aging step of the present invention.

Sample D, which had not been subjected to a plastic deformation step preceding the aging step, was also processed using an aging step in accordance with the present invention. However, this sample exhibited a markedly less favorable precipitate distribution and morphology when compared to those of the other samples. The result of the aging step on sample D is shown in the transmission electron microscopy ("TEM") micrograph of FIG. 4*a*. A similar TEM is provided with respect to sample A in FIG. 4*b*, which shows the complex precipitate structure present at the end of the process used to form sample A. A comparison of FIGS. 4*a* and 4*b* illustrates that, with respect to the large precipitates, a profound morphology change has resulted in sample A. The large particles present in sample D are thin, square plates, while those present in sample A are finer and more equiaxed with globular shapes, sometimes with facets. Further SEM analysis (not shown) also revealed that the process used to form sample D, which did not include a pre-aging plastic deformation step, results in an extremely non-uniform distribution of the plate-shaped precipitates.

Figure 5B:
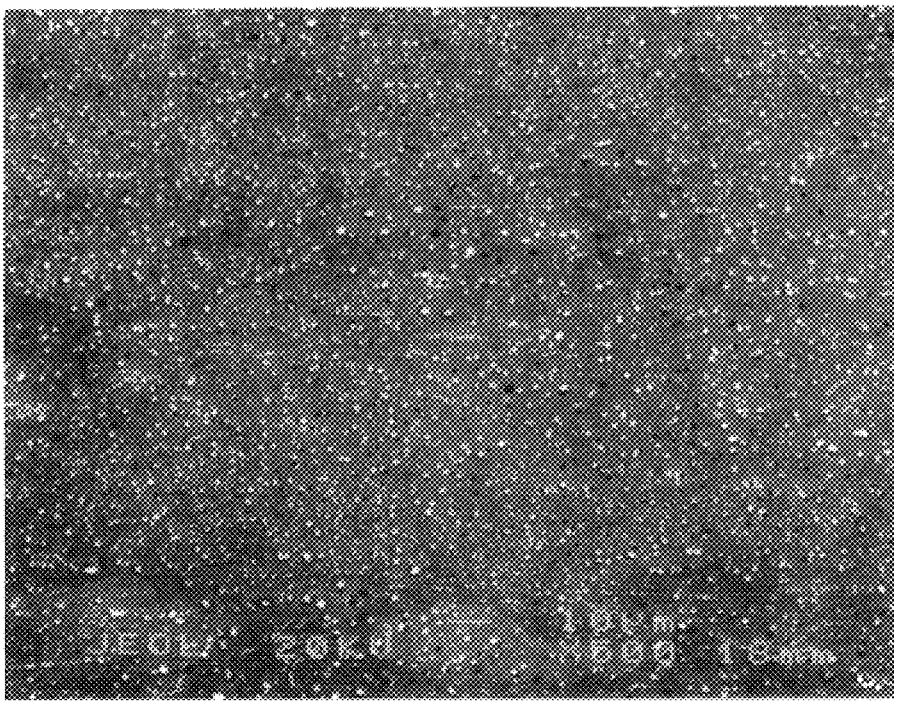
FIG. 5*b* is a SEM micrograph (500×) illustrating the distribution of precipitates in sample A, produced in accordance with the method of the present invention.

A sample that had been stretched by about 8% was subjected to an aging step at about 380° C. for about 17 hours. The stretched sample exhibited large globular precipitates and needle-like intragranular precipitates. It has been shown that the grain boundary particles coarsen while the intragranular particles resist coarsening. A comparison of FIG. 5*a* (stretched sample) and FIG. 5*b* (cold-rolled sample A) shows that the distribution of precipitates in sample A is extremely uniform compared to that produced in the stretched sample. It is believed that a dislocation network, instead of one of the desired higher-energy defect structures, was produced in the stretched sample. Thus, plastic deformation such as that applied to sample A by rolling is believed to be preferred over that applied by stretching, although stretching may still be an adequate mode of deformation where it is possible to impart sufficiently severe deformation to the material to produce a high-energy defect structure without inducing fracture.

The dimensional and distribution statistics for samples A, B, and C are shown in Table 2.

TABLE 2

AGING STATISTICS

| Samples | $D_{AVG}$ ($\mu$m) | $\sigma_D$ ($\mu$m) | $\lambda$ ($\mu$m) | $V_f$ (%) |
|---|---|---|---|---|
| A | 0.70 | 0.38 | 10.50 | 6.00 |
| B | 0.66 | 0.30 | 11.63 | 5.62 |
| C | 0.92 | 0.42 | 13.70 | 5.30 |

Where $D_{AVG}$=average particle diameter; $\sigma_D$=standard deviation of particle diameters; $\lambda$=mean free distance between particles; and $V_f$=volume fraction of particles.

Based on the results shown in Table 2 and FIGS. 3*a*, 3*b* and 3*c*, process A appeared to produce the best microstructural candidate for the PSN process. This was confirmed after a PSN process was applied to the material, as is discussed further below. It will be appreciated, however, that sample B or C may be commercially preferable over sample A despite their less ideal microstructures, in light of the fact that they require significantly shorter time periods for aging than sample A.

It can be seen from these examples that a process utilizing a relatively low-temperature aging step followed by a relatively high-temperature aging step (samples A and B) provides a more uniform precipitate distribution than that utilizing a single, high-temperature aging step (sample C). Specifically, although the precipitate distributions are similar for samples A and B, the distribution resulting from process C consisted of a lower number density of larger particles. This is probably due to the decreased driving force for nucleation of precipitates for sample C as compared with samples A and B, since sample C (in contrast to samples A and B) was not processed using an initial low-temperature aging step.

It can also be seen that the use of a first, low-temperature heating step may not result in the preferred globular precipitate morphology. Specifically, after being subjected to such a heating step, sample A comprised only needle and rod/lath-shaped precipitates. The globular-shaped precipitates appeared only during the second aging step.

Further analysis was performed to determine whether the globular precipitate morphology of sample A was the result of the plastic deformation imparted to the material prior to aging. As part of this analysis, a sample was subjected to about 300° C. for about 11 days, then about 380° C. for about 29 days. Examination of this sample by TEM revealed that the large precipitates still exhibited the same thin, square plate-like morphologies seen in FIG. 4*a*. No significant coarsening was observed, suggesting that the morphology difference between micron-sized precipitates from sample A and this sample was not the result of accelerated coarsening in sample A. Accordingly, it is believed that sample A exhibits generally globular precipitate morphologies, whereas this sample exhibits plate-like morphologies, because sample A was subjected to pre-aging plastic deformation. The specific reasons for the morphology change are not known, although there is evidence that it is due to different nucleation and growth conditions for the precipitates, or due to simultaneous precipitation and/or phase change and recrystallization within the deformation bands during aging.

Plastic Deformation

Once the aging step is completed, the alloy is subjected to a PSN process, the general parameters of which are well known in the art. See, e.g., U.S. Pat. No. 4,092,181 to Paton, et al., which is incorporated by reference herein in its entirety. The first step of this process is to plastically deform the material to form areas of strain, referred to as deformation zones, around the precipitates. Each deformation zone provides favorable sites for nucleation of recrystallized grains. As in the prior severe plastic deformation step, any mode of plastic deformation may be used, so long as it generally uniformly and completely penetrates the material. Also as in the severe plastic deformation step, the deformation of the present step may be carried out at room temperature or at other lower or higher temperatures, but preferably is performed at the temperature at or below the recrystallization temperature at which the greatest amount deformation is stored around the particles.

The number of passes and the amount of deformation applied per pass will depend upon the alloy being worked, as well as the size of the precipitates. In any event, the deformation stored in the alloy must be sufficient to ensure recrystallization through PSN. Preferably, it will be sufficient to produce fine grain sizes (preferably about 20 $\mu$m or less, and most preferably about 10 $\mu$m or less) after recrystallization.

For the example of samples A–C described above, unidirectional, room temperature rolling was carried out on 8.5" diameter rolls rotated at 11 rpm. The plates were reduced in thickness by a total of about 80% and 87% by applying 20% reductions. Sample E required a larger subsequent rolling reduction (about 92%) to attain the same final thickness as samples A–C reduced about 87%. This produced excellent results, as discussed in detail below in connection with the 87% reduction. It is contemplated that for some alloys, rolling reductions even less than about 80% will produce sufficient deformation to yield satisfactory results.

Figure 6:
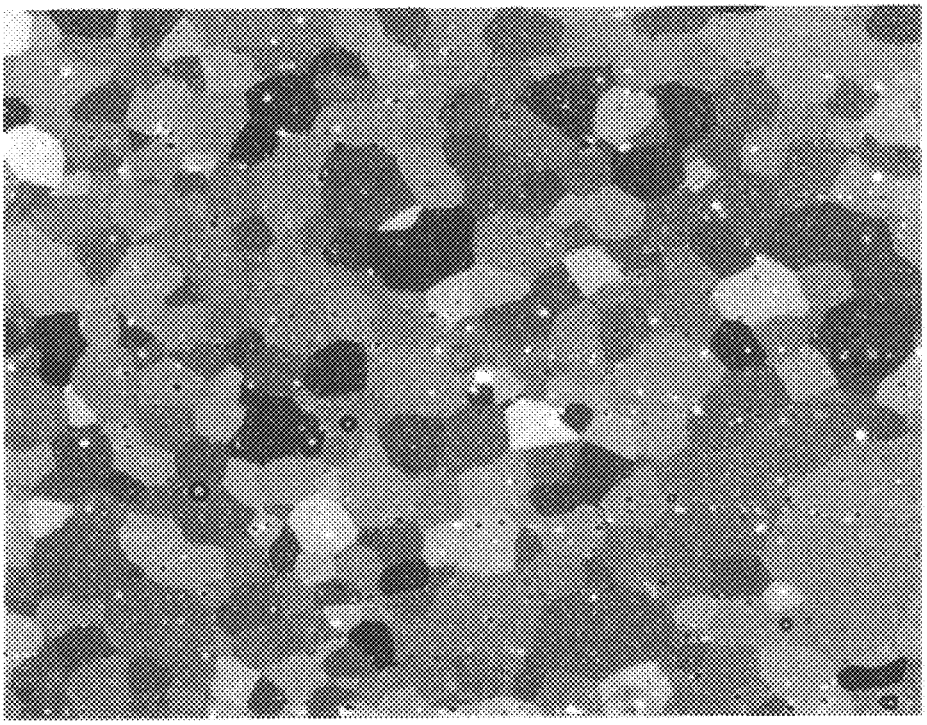
FIG. 6 is a SEM micrograph (200 μm width×150 μm height) illustrating the grain size of sample A processed using optimized downstream processing conditions in accordance with the method of the present invention.
Figure 7:
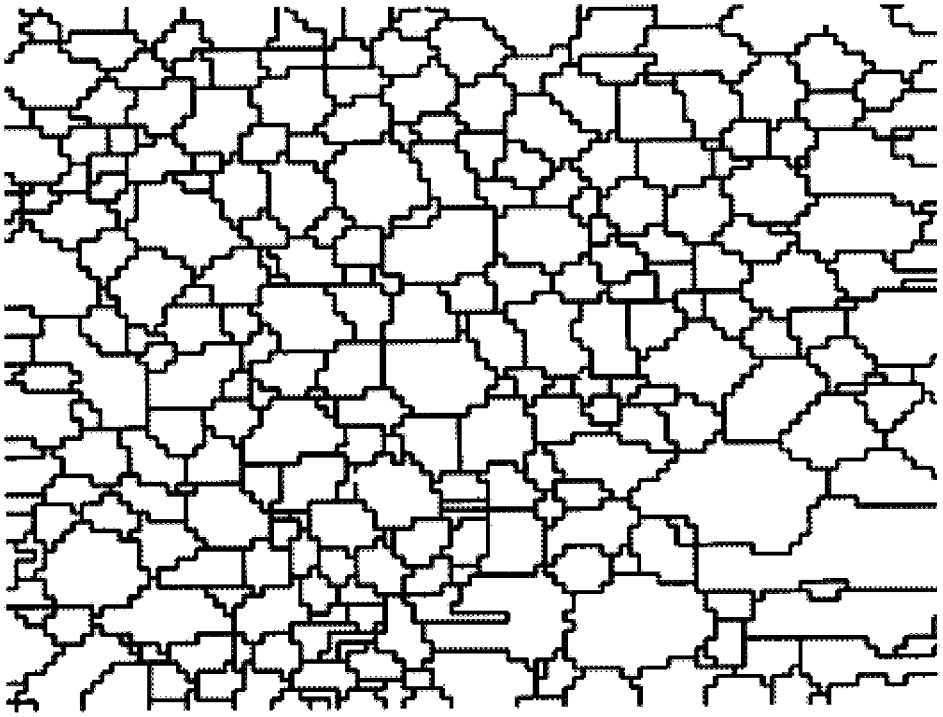
FIG. 7 is a 10° misorientation grain boundary map (200 μm width×150 μm height) corresponding to the SEM micrograph of FIG. 6.
Figure 8A:
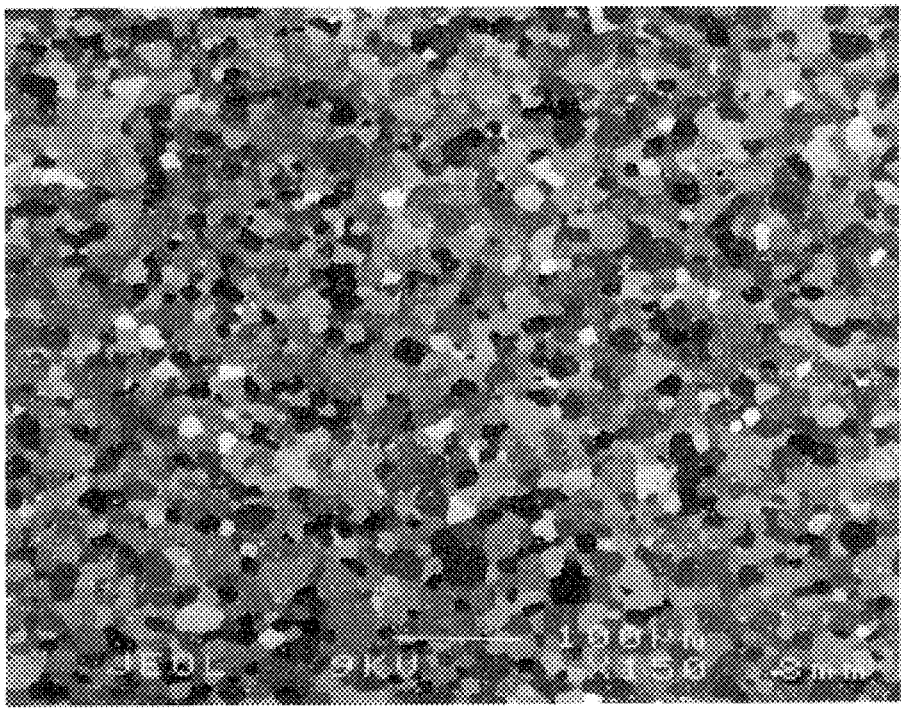
FIG. 8*a* is a SEM micrograph (150×) illustrating the recrystallized grain structure of sample A produced in accordance with the method of the present invention.
Figure 8B:
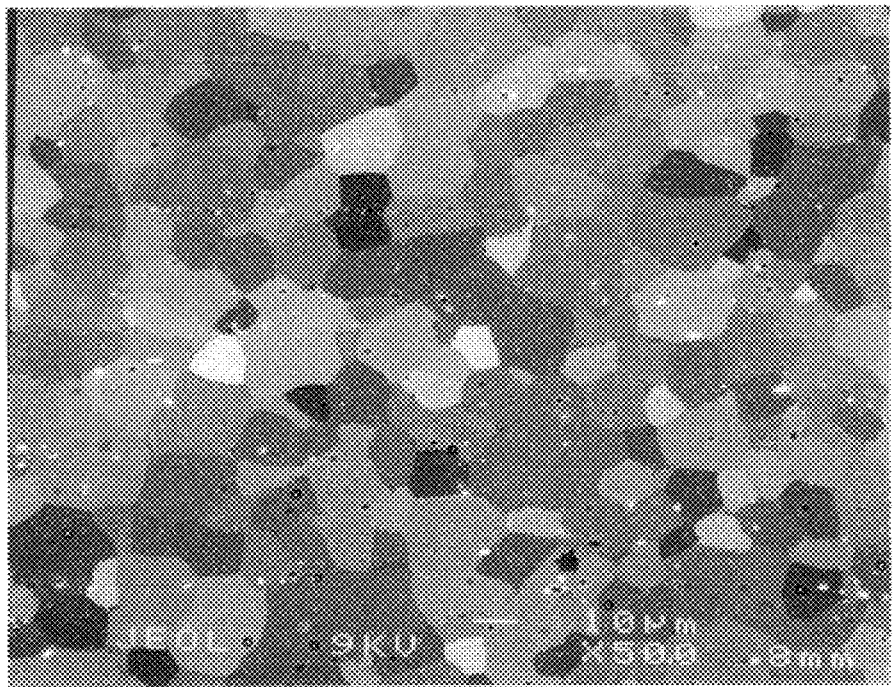
FIG. 8*b* is a SEM micrograph (500×) illustrating the recrystallized grain structure of sample A produced in accordance with the method of the present invention.
Figure 9A:
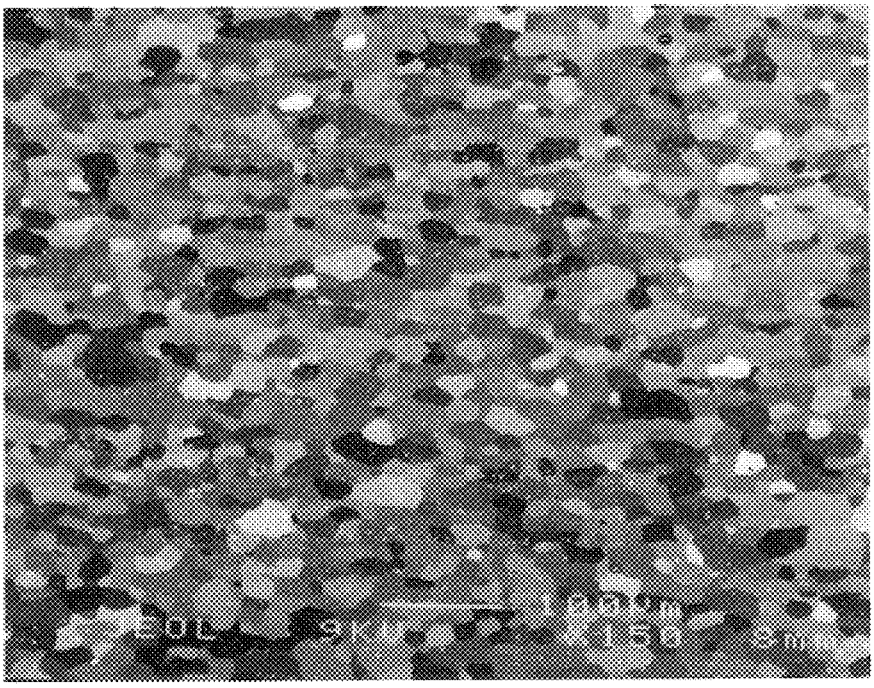
FIG. 9*a* is a SEM micrograph (150×) illustrating the recrystallized grain structure of sample B produced in accordance with the method of the present invention.
Figure 9B:
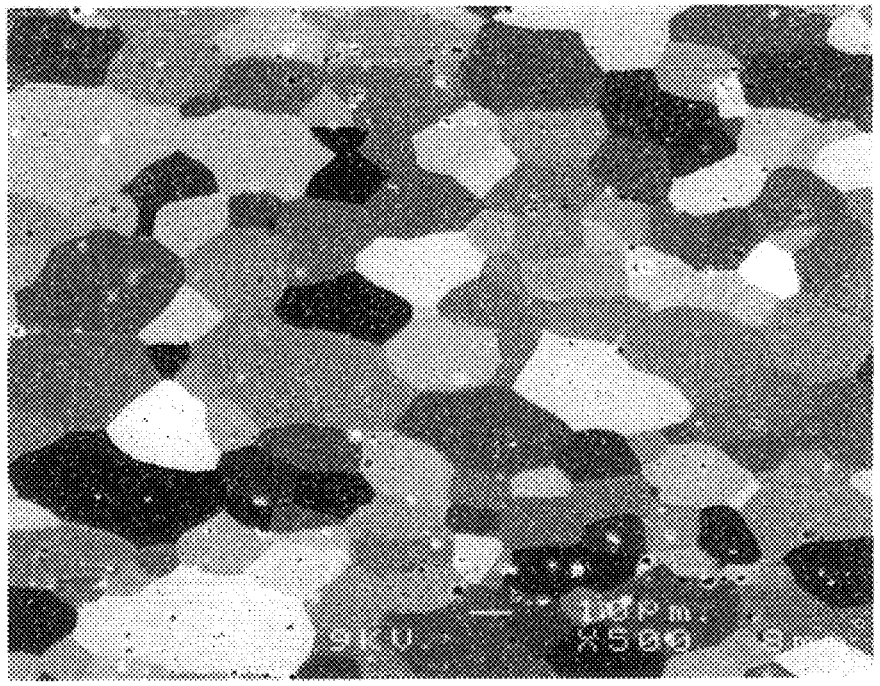
FIG. 9*b* is a SEM micrograph (500×) illustrating the recrystallized grain structure of sample B produced in accordance with the method of the present invention.
Figure 10A:
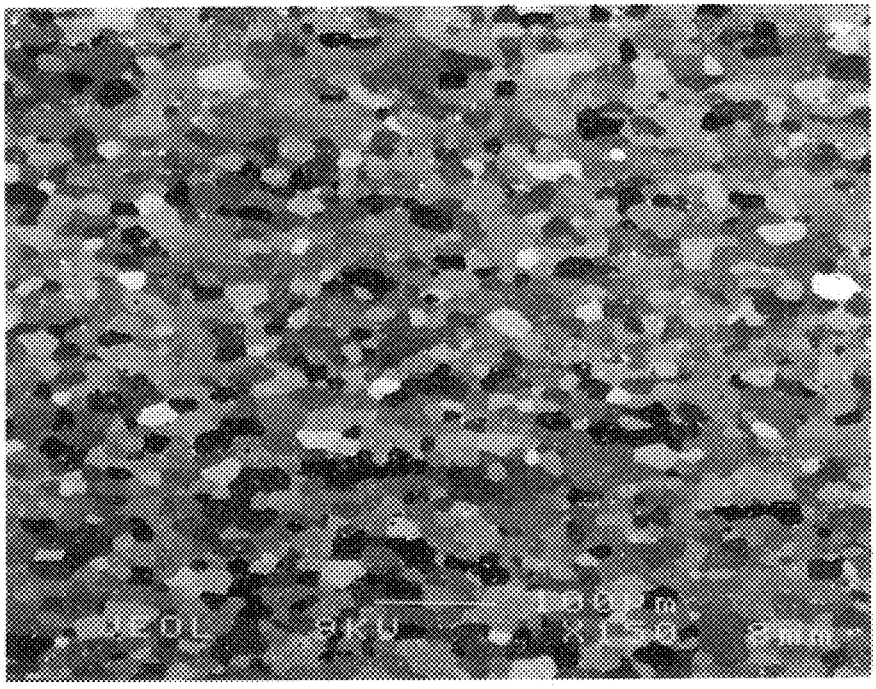
FIG. 10*a* is a SEM micrograph (150×) illustrating the recrystallized grain structure of sample C produced in accordance with the method of the present invention.
Figure 10B:
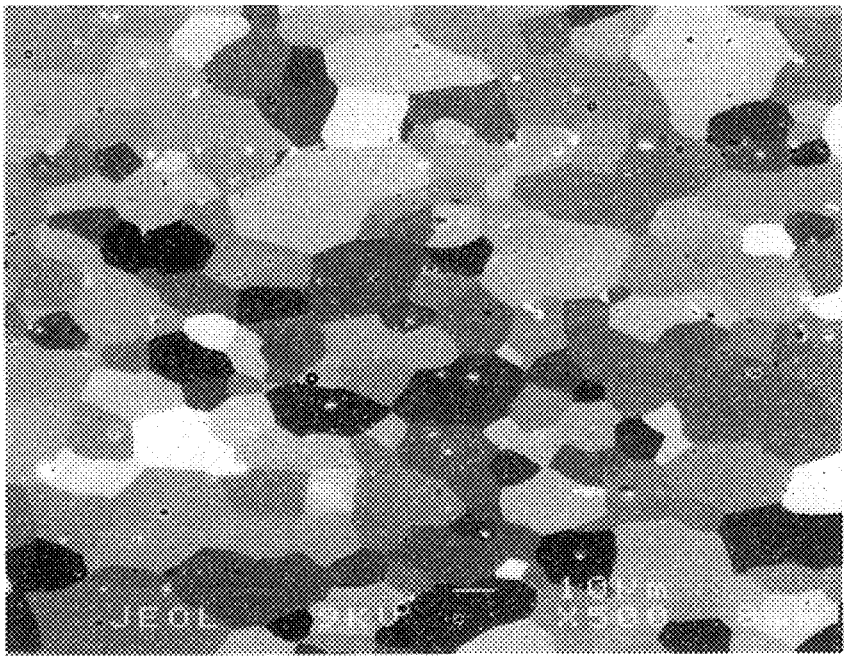
FIG. 10*b* is a SEM micrograph (500×) illustrating the recrystallized grain structure of sample C produced in accordance with the method of the present invention.
Figure 11A:
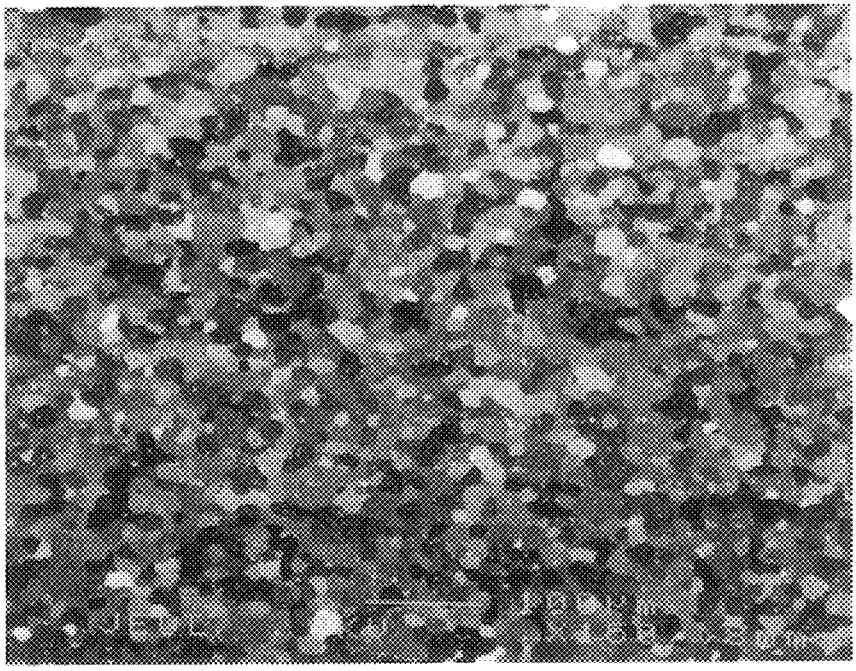
FIG. 11*a* is a SEM micrograph (150×) illustrating the recrystallized grain structure of sample B produced in accordance with the method of the present invention.
Figure 11B:
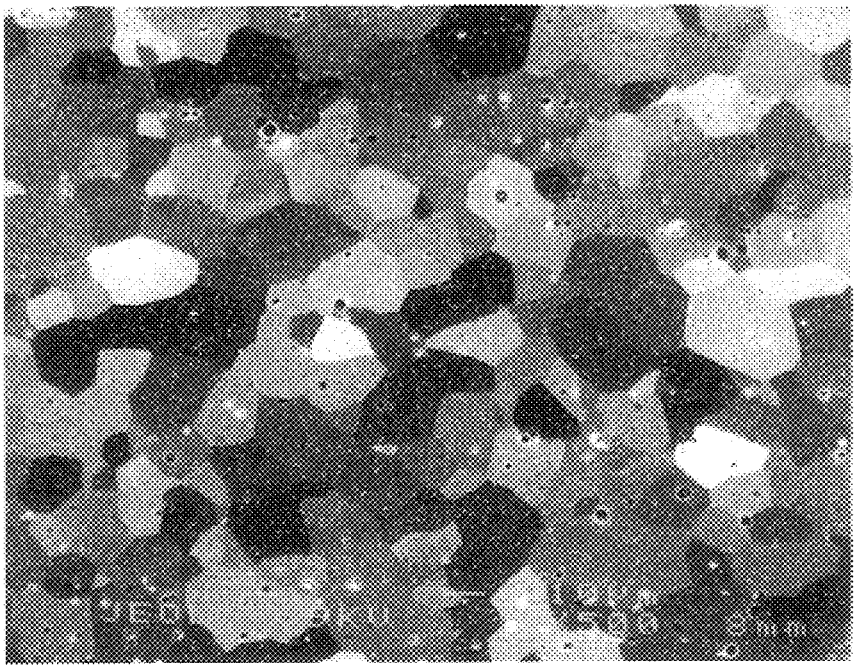
FIG. 11*b* is a SEM micrograph (500×) illustrating the recrystallized grain structure of sample B produced in accordance with the method of the present invention.

Sample A was further studied to optimize the effects of roll speed, reductions-per-pass and total rolling reduction on the final grain size and shape. For the six combinations of parameters obtainable from these three variables, average grain sizes (on LS sections at midthickness) ranged from about 9.5 to about 11.6 $\mu$m, with standard deviations increasing with grain size from about 4.7 to about 5.7 $\mu$m. The finest grain size corresponded to the slower roll speed, higher total rolling reduction, and larger number of reductions-per-pass is shown in the SEM micrograph of FIG. 6. Its corresponding grain boundary map is shown in FIG. 7, which illustrates grain boundaries with greater than 10° misorientation.

Static Recrystallization

The next step of the PSN process is to subject the alloy to a conventional static recrystallization process to recrystallize to a fine grain structure. During the recrystallization step, the highly strained regions of the deformation zones or other high-energy defect structures have a significant effect in encouraging nucleation of recrystallization. The recrystallized grains grow to consume the deformation zones until the grains impinge on one another or until the drag force exerted on them by dispersoid particles balances the driving force for grain growth. Thus, important to controlling grain growth in this process is the use of insoluble dispersoids present in the alloy.

As persons having skill in the art will recognize, the parameters of the recrystallization process will depend upon the composition of the particular alloy being processed and the amount of deformation stored in the material. Preferably, however, the heat-up rate to the temperature at which recrystallization occurs is sufficiently rapid that no recovery occurs in the deformation zones, which would effect a reduction in the driving force for nucleation of recrystallization. Indeed, when PSN is exploited for grain-size control, an increased heating rate during recrystallization has been shown to increase the number of activated recrystallization nuclei. Thus, the heat-up rate preferably is as high as possible. The heating time should only be as long as necessary to achieve complete recrystallization.

The temperature chosen for recrystallization must be equal to or greater than the critical recrystallization temperature for the material at which recrystallization occurs and recovery is minimized. In one embodiment of the present invention, recrystallization occurs during superplastic forming, in which case the temperature chosen for recrystallization is the superplastic forming temperature. Regardless of the recrystallization temperature used, care must be taken to rapidly cool the alloy once recrystallization is complete. Accordingly, cold water quenching or its equivalent is preferred.

For samples A, B, C and E, plastically deformed as described above, a recrystallization temperature of about 540° C. was used, which is approximately the same temperature as that used for solution heat treating. An air furnace was first fully preheated to this temperature. The alloy samples were placed in the heated furnace and allowed to soak for about five minutes, after which they were quenched using room temperature water.

The recrystallized grain structures are characterized in Table 3, which contains statistics related to average grain diameters and aspect ratios (measured on LS planes, at midwidth and midthickness) for samples A, B, C and E.

TABLE 3

GRAIN STATISTICS FOR SAMPLES A–C

| Sample | $D_{AVG}$ ($\mu$m) | $\sigma_D$ ($\mu$m) | AR | $\sigma_{AR}$ | Roundness |
|---|---|---|---|---|---|
| A | 9.48 | 4.72 | 1.65 | 0.55 | 1.64 |
| B | 11.63 | 5.58 | 1.85 | 0.80 | 1.81 |
| C | 10.80 | 5.63 | 1.89 | 0.67 | 1.80 |
| E | 10.82 | 4.76 | 1.63 | 0.58 | 1.74 |

Where $D_{AVG}$=average grain diameter; $\sigma_D$=standard deviation of grain diameters; and AR=average grain aspect ratio; $\sigma_{AR}$=standard deviation of grain aspect ratios; and Roundness=proximity to circular shape=(perimeter/area×4π).

The grain sizes, aspect ratios and size distributions represented in Table 3 were determined using quantitative image analysis of grain boundary maps generated from microtexture data, which minimizes the influence of subgrain size on the average grain size. Thus, as will be appreciated by persons skilled in the art, this technique provides a much more rigorous and conservative evaluation of grain size statistics than do the optical microscopy 5 techniques used in several of the background studies discussed previously in this application. Indeed, unlike the technique employed in connection with the results presented here, optical microscopy techniques do not permit one to easily distinguish between subgrain boundaries and grain boundaries, making it virtually impossible to properly and accurately limit grain sizes to areas bounded by high-angle grain boundaries.

The data presented in Table 3 shows a fine grain structure with average grain sizes of about 9.5 $\mu$m to about 11.6 $\mu$m. The grains are nearly equiaxed, having average aspect ratios of about 1.6 to about 1.9. The size and aspect ratio distributions are narrow, indicating a high degree of uniformity of this grain structure. Compared with commercial 6xxx aluminum alloys of similar composition (Al—Mg—Si or Al—Mg—Si—Cu), the average grain sizes, aspect ratios, distributions and roundness of these samples are statistically superior.

It is apparent from both a qualitative comparison of FIGS. 8–11 and a quantitative comparison of the average grain diameters shown in Table 3 that the process used to produce sample A yielded the finest, most equiaxed and uniform grain structure. Table 4 shows the results of grain boundary map analysis taken from the LS, LT and ST planes of the recrystallized sample A produced using the optimized downstream rolling and recrystallization conditions previously discussed. As illustrated by Table 4, the result of the present process is a fine (average grain size of about 10.3 $\mu$m over the LS planes), equiaxed grain structure. In addition, the average three-dimensional grain size increased only to about 10.7 $\mu$m after a one hour exposure to the same temperature, demonstrating that the grain size is statically stable, a critical property if the material is to be useful as a superplastic alloy. It is believed that in the alloy of sample A, manganese-bearing dispersoid particles are responsible for preventing further grain growth.

TABLE 4

GRAIN SIZES FOR ALLOY SAMPLE A

| Plane | Soak Time (min) | $D_{AVG}$ ($\mu$m) | $\sigma_D$ ($\mu$m) |
|---|---|---|---|
| LS | 5 | 9.48 | 4.47 |
| LT | 5 | 10.35 | 5.50 |
| ST | 5 | 10.90 | 4.97 |
| LS | 60 | 10.97 | 4.72 |
| LT | 60 | 10.47 | 4.54 |
| ST | 60 | 10.72 | 4.87 |

Where $D_{AVG}$=average grain diameter; and $\sigma_D$=standard deviation of grain diameters.

Orientation Distribution Function and microtexture analyses indicate a very weak texture on both LT and LS planes.

A sample A alloy made from the ingot subjected to a low-temperature preheat, as described previously, also was 87% cold rolled at room temperature and statically recrystallized. The resultant grains were finer but less equiaxed than the grains of the sample A described in Table 4, the statistics for which were derived from the ingot subjected to the conventional preheat. Thus, it was concluded that ingot subjected to the standard preheat is preferable to ingot subjected to the low-temperature preheat for processing using the method of the present invention.

Superplastic Results of the Present Invention

Figure 12:
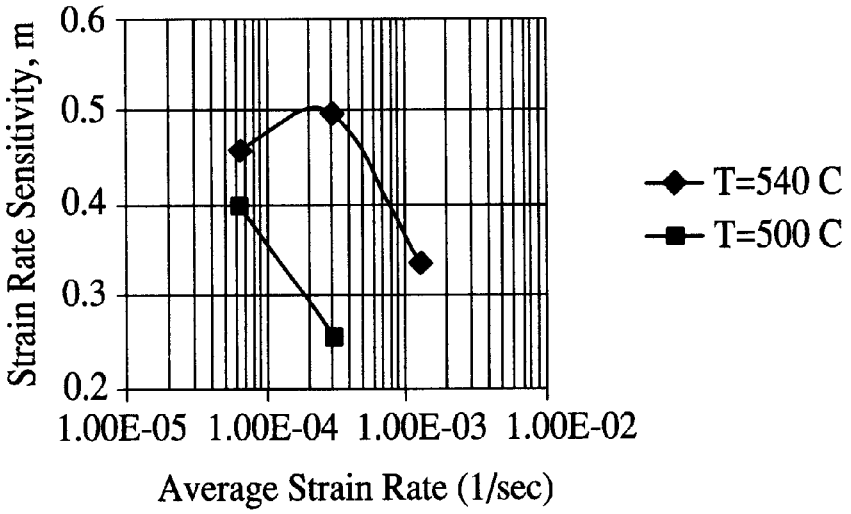
FIG. 12 is a graph illustrating the variation of strain rate sensitivity with strain rate for uniaxial, step strain rate tests of sample A, produced in accordance with the method of the present invention, at 500° C. and 540° C.
Figure 13:
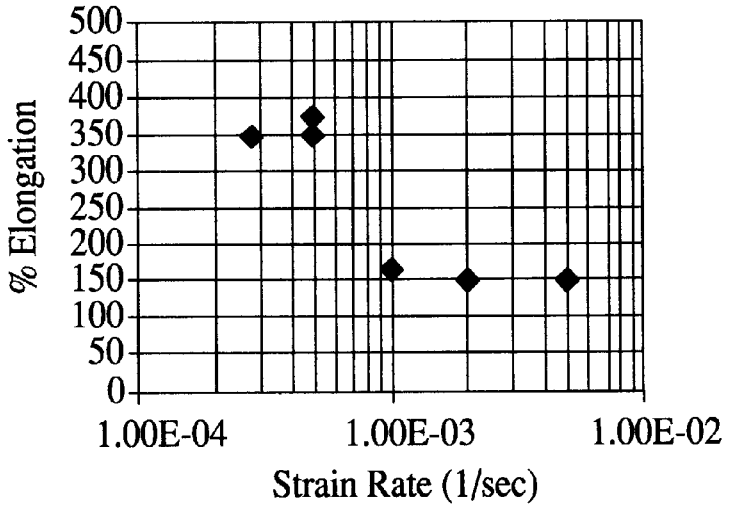
FIG. 13 is a graph illustrating the variation of elongation with strain rate for sample A, produced in accordance with the method of the present invention, at a temperature of 540° C.
Figure 14:
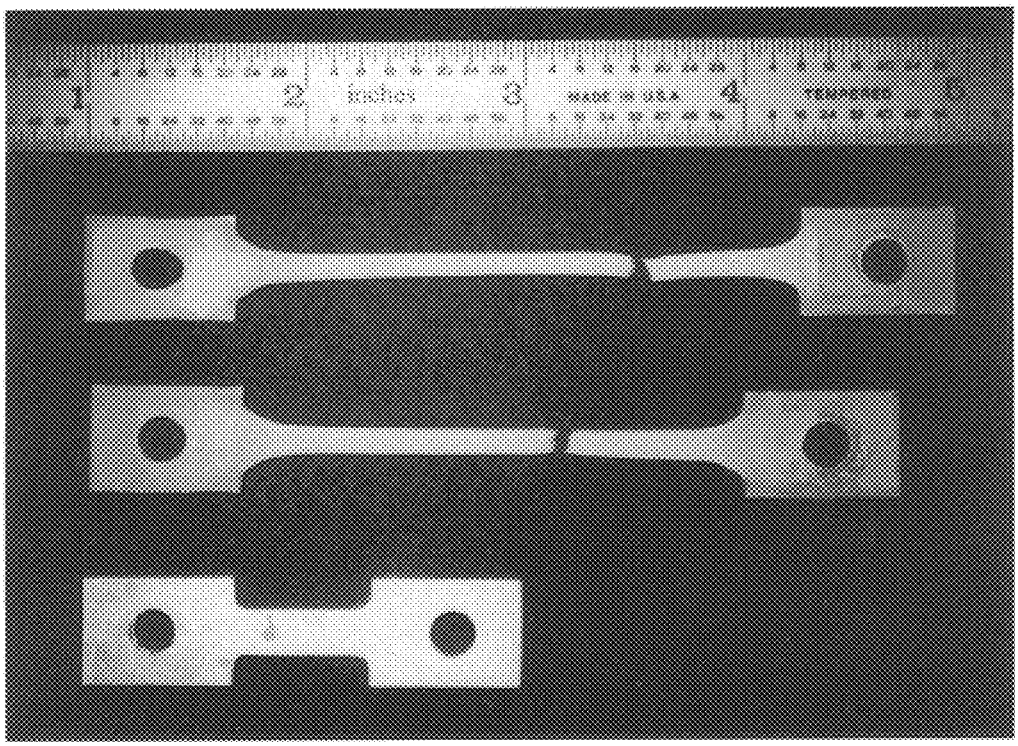
FIG. 14 is a photograph of an undeformed sample alongside samples deformed to 350 to 375%, each of the samples representing sample A, produced in accordance with the method of the present invention.

FIG. 12 illustrates the variation of strain rate sensitivity with strain rate for uniaxial, step strain rate tests at 500° C. and 540° C., performed on the version of sample A produced using the optimized downstream rolling and recrystallization conditions previously discussed. The material exhibited a maximum strain rate sensitivity of 0.5, which occurred at 540° C. for a strain rate range of $2\times10^{-4}$ $s^{-1}$ to $5\times10^{-4}$ $s^{-1}$ (based on initial gage length). FIG. 13 shows the elongation as a function of strain rate for a temperature of 540° C. The elongation to fracture reached 375% with a corresponding maximum stress of approximately 680 psi (4.7 MPa). FIG. 14 shows an undeformed sample alongside samples deformed to 350 to 375%. Such superplastic elongation results are superior to any results previously reported for non-eutectic 6xxx aluminum alloys. Indeed, the marginal superplastic results of Chung, et al. for a 6013 aluminum alloy, as discussed previously, yielded only 230% elongation at 520° C. at a strain rate of $3\times10^{-4}$ $s^{-1}$ and a flow stress of 972 psi (6.7 MPa). Chung, et al. also obtained a maximum strain rate sensitivity of only 0.38. It also may be noted for comparison that a baseline, commercially available 6013-T4 sheet tested under the same conditions as sample A fractured after about 120% elongation with a maximum stress of approximately 860 psi (5.9 MPa).

Accordingly, the results of the process of the present invention, as exemplified by sample A, illustrate that the distribution of precipitates in an alloy may be significantly homogenized by creating and exploiting deformation bands or other high-energy defect structures as heterogeneous nucleation sites for precipitation. This approach, preferably coupled with a multi-step low and high temperature aging process, produces the uniform distribution of micron-size precipitates necessary for the subsequent development of a fine, equiaxed grain structure following PSN that is stable at superplastic forming temperatures. For many alloys, superior superplastic properties may result.

In particular, the grain structure characteristics, static stability and superplastic properties of this superplastic alloy are exceptional. Indeed, the 6013/6111 alloy produced using the preferred process of the present invention is markedly superior to those reported previously for other 6xxx aluminum alloys claiming superplastic properties. Given its superior characteristics, and the relatively energy efficient and rapid process by which it is produced, this alloy is potentially useful for many commercial applications, including many conceivable applications in the aerospace and automotive industries. In addition, the process of the present invention is expected to be similarly useful for many other alloys, including aluminum 6061, 6063 and 6066 alloys, as well as many other age-hardenable aluminum alloys, and including magnesium, iron, titanium, nickel and other alloy systems.

It is believed that the many advantages of the present invention will now be apparent to those skilled in the art. It will also be apparent that a number of variations and modifications may be made thereto without departing from its spirit and scope. Accordingly, the foregoing description is to be construed as illustrative only, rather than limiting. The present invention is limited only by the scope of the following claims.

What is claimed is:

1. A method for producing a superplastic alloy, said method comprising:

providing an alloy for processing, said alloy comprising a matrix phase and at least two alloying elements, at least one of said alloying elements being, or being capable of forming, a dispersoid phase substantially insoluble in said matrix phase;

solution heat treating said alloy;

cooling the alloy to form a supersaturated solid solution;

plastically deforming said alloy in a first deformation step sufficiently to form a high-energy defect structure, thereby forming nucleation sites useful for the subsequent nucleation of precipitates;

aging said alloy, thereby forming precipitates at said nucleation sites; and plastically deforming said alloy in a second deformation step, and statically recrystallizing said alloy, through a particle-stimulated nucleation process.

2. The method of claim 1, wherein said step of providing an alloy for processing comprises providing an aluminum alloy.

3. The method of claim 2, wherein said aluminum alloy is selected from the group consisting of aluminum alloys 6013, 6111, 6061, 6063, and 6066.

4. The method of claim 1, wherein said cooling step comprises quenching.

5. The method of claim 1, wherein said first deformation step comprises plastically deforming said alloy sufficiently to form deformation bands.

6. The method of claim 1, wherein said first deformation step comprises cold rolling said alloy.

7. The method of claim 6, wherein said first deformation step further comprises cold rolling said alloy at room temperature.

8. The method of claim 7, wherein said first deformation step further comprises cold rolling said alloy to a reduction of at least about 30%.

9. The method of claim 1, wherein said aging step comprises a first heating step at a first temperature and a second heating step at a second higher temperature.

10. The method of claim 9, wherein said precipitates are formed during said first heating step and coarsened during said second heating step.

11. The method of claim 9, wherein said alloy is cooled after said first heating step and after said second heating step.

12. The method of claim 1, wherein said second deformation step comprises cold rolling said alloy.

13. The method of claim 12, wherein said second deformation step further comprises cold rolling said alloy at room temperature.

14. The method of claim 1, wherein said static recrystallization step comprises rapidly heating said alloy to a temperature at which recrystallization occurs.

15. The method of claim 1, wherein said static recrystallization step comprises heating said alloy to a temperature in the range of a solution heat-treatmnent temperature for said alloy.

16. The method of claim 1, wherein said static recrystallization step comprises heating said alloy to a superplastic forming temperature of said alloy.

17. A method for producing a superplastic aluminum alloy, said method comprising:

providing an alloy for processing, said alloy being a 6013/6111 alloy;

solution heat treating said alloy;

cooling the alloy to form a supersaturated solid solution;

plastically deforming said alloy in a first deformation step sufficiently to form a high-energy defect structure, thereby forming nucleation sites useful for the subsequent nucleation of precipitates;

aging said alloy, thereby forming precipitates at said nucleation sites;

plastically deforming said alloy in a second deformation step to provide sufficient strain energy in said alloy to ensure recrystallization; and statically recrystallizing said alloy.

18. The method of claim 17, wherein said 6013/6111 alloy has the approximate composition 97.3 wt % Al—0.8 wt % Mg—0.7 wt % Si—0.8 wt % Cu—0.3 wt % Mn—0.1 wt % Fe.

19. The method of claim 17, wherein said solution heat treating step is performed at a temperature of about 540° C. for about one hour.

20. The method of claim 17, wherein said cooling step comprises quenching.

21. The method of claim 17, wherein said first deformation step comprises cold rolling said alloy.

22. The method of claim 21, wherein said first deformation step comprises cold rolling said alloy to a reduction of at least about 30%.

23. The method of claim 22, wherein said first deformation step comprises cold rolling said alloy to a reduction of at least about 60%.

24. The method of claim 17, wherein said first deformation step comprises plastically deforming said alloy sufficiently to form deformation bands.

25. The method of claim 17, wherein said first deformation step is performed such that, after subsequent aging, said alloy exhibits globular or near-spheroid shaped precipitates.

26. The method of claim 17, wherein said aging step comprises a first heating step at a first temperature and a second heating step at a second higher temperature.

27. The method of claim 26, wherein said precipitates are formed during said first heating step and coarsened during said second heating step.

28. The method of claim 26, wherein said alloy is cooled after said first heating step and after said second heating step.

29. The method of claim 26, wherein said first heating step is performed at about 300° C. and said second heating step is performed at about 380° C.

30. The method of claim 29, wherein the duration of said first heating step is about 24 hours, and the duration of said second heating step is about 24 hours.

31. The method of claim 26, wherein said first heating step is performed at about 300° C. and said second heating step is performed at about 450° C.

32. The method of claim 31, wherein the duration of said first heating step is about 24 hours, and the duration of said second heating step is about 2 hours.

33. The method of claim 17, wherein said aging step comprises heating said alloy at a temperature of about 450° C. for about 2 hours.

34. The method of claim 17, wherein said second deformation step comprises cold rolling said alloy.

35. The method of claim 34, wherein said second deformation step comprises cold rolling said alloy to a reduction of at least about 80%.

36. The method of claim 35, wherein said second deformation step comprises cold rolling said alloy to a reduction of at least about 87%.

37. The method of claim 36, wherein said second deformation step comprises cold rolling said alloy to a reduction of at least about 92%.

38. The method of claim 17, wherein said static recrystallization step comprises rapidly heating said alloy to a temperature at which recrystallization occurs.

39. The method of claim 38, wherein said static recrystallization step comprises heating said alloy to a temperature of about 540° C. for about 5 minutes.

40. A method for producing a superplastic alloy, comprising:

providing an alloy solid solution comprising a matrix phase and at least two alloying elements, at least one of said alloying elements comprising dispersoids or being capable of forming dispersoids, which are substantially insoluble in said matrix phase;

plastically deforming said alloy in a first deformation step sufficiently to form a high energy defect structure, thereby forming nucleation sites useful for subsequent nucleation of precipitates;

aging said alloy, thereby forming precipitates at said nucleation sites; and plastically deforming said alloy in a second deformation step and recrystallizing said alloy.

41. The method of claim 40, wherein providing an alloy solid solution comprises providing a supersaturated solid solution containing dispersoids which comprise particles having a diameter of approximately less than one micron.

42. The method of claim 41, wherein the supersaturated solid solution is formed by solution heat treating said alloy and rapidly cooling said alloy.

43. The method of claim 41, wherein the high energy defect structure comprises at least one of deformation bands, microbands, kink bands and bands of secondary slip.

44. The method of claim 43, wherein the alloy comprises a 6xxx aluminum alloy.

45. The method of claim 44, wherein the 6xxx aluminum alloy is selected from a group consisting of 6013 and 6111 alloys.

46. The method of claim 44, wherein the first deformation step comprises cold rolling said alloy to a reduction of at least 30%.

47. The method of claim 46, wherein the first deformation step comprises cold rolling said alloy to a reduction of at least 60%.

48. The method of claim 46, wherein the precipitates comprise relatively equiaxed precipitate particles.

49. The method of claim 48, wherein:

the second deformation step is performed prior to the recrystallization step; and the recrystallization step comprises a static recrystallization step through a particle-stimulated nucleation process.

50. The method of claim 48, wherein the first deformation step uniformly deforms the alloy such that the precipitates are distributed uniformly throughout the alloy after the step of aging.

* * * * *